US006557269B1

(12) United States Patent
Schüler et al.

(10) Patent No.: US 6,557,269 B1
(45) Date of Patent: May 6, 2003

(54) METHOD AND DEVICE FOR REDUCING THE VOLUME OR PRESSURE OF A FLUID WHICH IS DRIVEN THROUGH AN OPENING BY MOVING SURFACES

(75) Inventors: Dietrich Schüler, Essen (DE); Ewald Georg Welp, Erkrath (DE); Bruno Holtmann, Dielsdorf (CH); Armin Hutzenlaub, Wiehl (DE); Hans Rückert, Ratingen (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/786,455

(22) PCT Filed: Aug. 6, 1999

(86) PCT No.: PCT/EP99/05691

§ 371 (c)(1),
(2), (4) Date: May 16, 2001

(87) PCT Pub. No.: WO00/13998

PCT Pub. Date: Mar. 16, 2000

(30) Foreign Application Priority Data

Sep. 2, 1998 (DE) ..... 198 39 916

(51) Int. Cl.[7] ..... F26B 3/00

(52) U.S. Cl. ..... 34/455; 34/459; 34/466; 34/117; 34/618

(58) Field of Search ..... 34/444, 452, 453–466, 34/108, 110, 111–117, 611–620, 623–625; 162/100, 109, 115–122, 135, 202–207, 261, 265, 271, 289; 226/196.01

(56) References Cited

U.S. PATENT DOCUMENTS 4,250,211 A * 2/1981 Damrau et al. ..... 118/411
4,533,563 A * 8/1985 Dahlgren et al. ..... 118/261

(List continued on next page.)

FOREIGN PATENT DOCUMENTS

| | | | |
|---|---|---|---|
| DE | 3633434 A1 * | 4/1988 | ..... F26B/13/20 |
| EP | 0 130 158 | 1/1985 | |
| EP | 0 239 950 | 10/1987 | |
| EP | 0 298 299 | 1/1989 | |
| EP | 0 393 519 | 10/1990 | |
| FR | 2 153 984 | 5/1973 | |
| FR | 2 442 785 | 6/1980 | |
| GB | 1 098 036 | 1/1968 | |
| WO | WO 94/19536 | 9/1994 | |

*Primary Examiner*—Ira S. Lazarus
*Assistant Examiner*—Andrea M. Ragonese
(74) *Attorney, Agent, or Firm*—Herbert Dubno

(57) ABSTRACT

The invention relates to a method and device for reducing the volume or pressure of a fluid which is driven through an opening (3, 17) by moving surfaces. According to said method, the opening (3, 17) is divided in at least two flow channels (5, 6, 14) by means of one or more flexible separation members (4). Each separation member (4) is attached at its rear end relatively to the direction of displacement of said surfaces, and its front finishing end extends inside said opening (3, 17). The inventive method can be advantageously implemented during production and further transformation of strip-shaped materials (paper, cardboard strips, plastic material sheets) for bringing the strip which moves on an element (cylinder, roll, rigid guiding element, winding reel) into close contact with said element.

17 Claims, 5 Drawing Sheets

U.S. PATENT DOCUMENTS 4,834,018 A * 5/1989 Sollinger et al. ..... 118/410
4,880,671 A * 11/1989 Sollinger et al. ..... 118/407
4,893,741 A * 1/1990 Heinzmann ..... 162/290
4,930,437 A * 6/1990 Eckhard ..... 118/410
4,949,472 A * 8/1990 Arnone ..... 34/205
5,222,679 A * 6/1993 Dropczynski et al. ..... 242/521
5,264,246 A * 11/1993 Ikeno ..... 427/240
5,302,252 A * 4/1994 Gotz ..... 162/206
5,439,520 A * 8/1995 Reich ..... 118/256
5,443,638 A * 8/1995 Gartmann et al. ..... 118/209
5,538,555 A * 7/1996 Wille et al. ..... 118/261
5,553,805 A * 9/1996 Ruegg ..... 242/534
5,558,716 A * 9/1996 Mitani et al. ..... 118/410
5,639,338 A * 6/1997 Beckamnn ..... 156/159
5,685,909 A * 11/1997 Reich et al. ..... 118/115
5,772,338 A * 6/1998 Hillmann et al. ..... 384/470
5,772,849 A * 6/1998 Meschenmoser ..... 162/358.2
5,788,771 A * 8/1998 Madrzak et al. ..... 118/261
5,795,393 A * 8/1998 Isfort ..... 118/410
5,820,063 A * 10/1998 Fissman et al. ..... 242/530.4
5,885,350 A * 3/1999 Henninger ..... 118/413
6,280,573 B1 * 8/2001 Lindsay et al. ..... 162/198

* cited by examiner

METHOD AND DEVICE FOR REDUCING THE VOLUME OR PRESSURE OF A FLUID WHICH IS DRIVEN THROUGH AN OPENING BY MOVING SURFACES

TECHNICAL FIELD

In a number of fields of technology, moving machine elements or webs or strip-shaped elements to be treated are so arranged or displaced that they form a converging gap. The moving surfaces of the element or material entrained a fluid (gas, liquid) into the gap with a volume or pressure giving rise to negative effects in the event certain boundary conditions are exceeded. The geometry of the gap is either shape stable or of variable shape. Stable shape gaps are formed for example between two rotating rollers whose axes are parallel or between a moving web supported by one guide element and a further element. Shape-variable gaps are formed for example by one element (drive roller, guide roll or roller, winding roll, etc.) and a web running to it or also between two webs running together.

An important technical field of use for the process and the device is the production and further processing of web-shaped materials (paper, cardboard, synthetic resin foils) with which it is frequently required to bring the web into very close contact with an element (roller, roll, or fixed guide element, winding roll).

Especially at high web speeds, the air entrained into the converging gap can be problematical. The entrained air creates an overpressure which presses the web away from the element and which is thus the cause of undesired negative effects. Thus in the roll up of webs of material to wound rolls, as the oncoming web passes onto the wound roll air can be wound into the roll in an undesired manner. With drive rollers the web may begin to float because of an entrained air cushion. The adhesion and thus the drive force is lost. With rollers or other guide elements which serve to control web travel, a floating occurs which interferes with the controlled movement and causes the web to shift laterally. With cooling or heating rollers for webs the entrained air volume reduces the heat exchange with the roll surface and the web and also the heating or cooling efficiency. Since heating and cooling roller groups usually also serve as the traction stations for the web, good adhesion is also required to impart tension to the web. In the cooling of material webs for example paper or cardboard, the entrained air cushion is detrimental to the transfer of the coating material from the applicator to the web.

STATE OF THE ART

There are various methods known to counteract the negative effects which find their origin in the entrainment of air into a gap between a web and a further element.

Thus in the winding of webs into wound rolls, pressure rollers are used which squeeze the air out as the web meets the wound roll. Pressure rollers are expensive in their construction and can mark sensitive materials. They can also influence the roll hardness during the wind up in an undesired manner. An improvement in contact with pressure rollers is not possible when the web is coated or when folds may form during the pressing. With drive rollers it is known to improve the contact by a corresponding shaping of the roller surface, for example, by the application of grooves. All of these techniques have in common that they are either relatively expensive to construct or can give rise to undesirable side effects.

A further field of use of the invention is the coating of material webs in the process in which a liquid coating material is applied by means of an applicator element, especially an applicator roller which forms a narrowing application gap with the web. The liquid coating material fed into the application gap of the application element builds up a pressure which influences the quantity applied to the web. An excessively high pressure in the gap, in the case of bibulous paper or cardboard webs, causes the coating material, especially pigment containing coloring agents to penetrate in undesirably large quantities into the web.

DESCRIPTION OF THE INVENTION

The invention thus has as its object the provision of a method by which the volume or the pressure of a fluid entrained into a gap by moving surfaces can be positively reduced in a simple manner without giving rise to undesirable side effects. This object is achieved with the features of patent claim 1.

The separating element used in accordance with the invention effects a pressure or volume reduction in the gap without contacting moving surfaces for example of the web or of another element forming the gap. The separating element requires neither a mechanical drive nor a special energy supply. It enables the possibility of influencing by itself through its shape and position the pressure of volume relationships in the gap. Thus, for example, in the winding up of a material web, even with a reduced quantity of entrained air, the desired winding quality can be maintained.

The invention makes use of the physical effect that the transition between two streams separated by a partition into two passages of reduced height to only one stream in one passage of greater height, results in a pressure reduction depending upon the viscosity of the flowing fluid, the length and height of the passages and the flow velocity and/or a reduction in the volume flow of the fluid into the gap.

The dependent claims contain preferred variants and embodiments of the invention in its use in the production and processing of web shaped materials.

BRIEF DESCRIPTION OF THE DRAWING

The drawing serves to explain the invention based upon the schematically illustrated embodiment.

MANNER OF CARRYING OUT THE INVENTION

Figure 1:
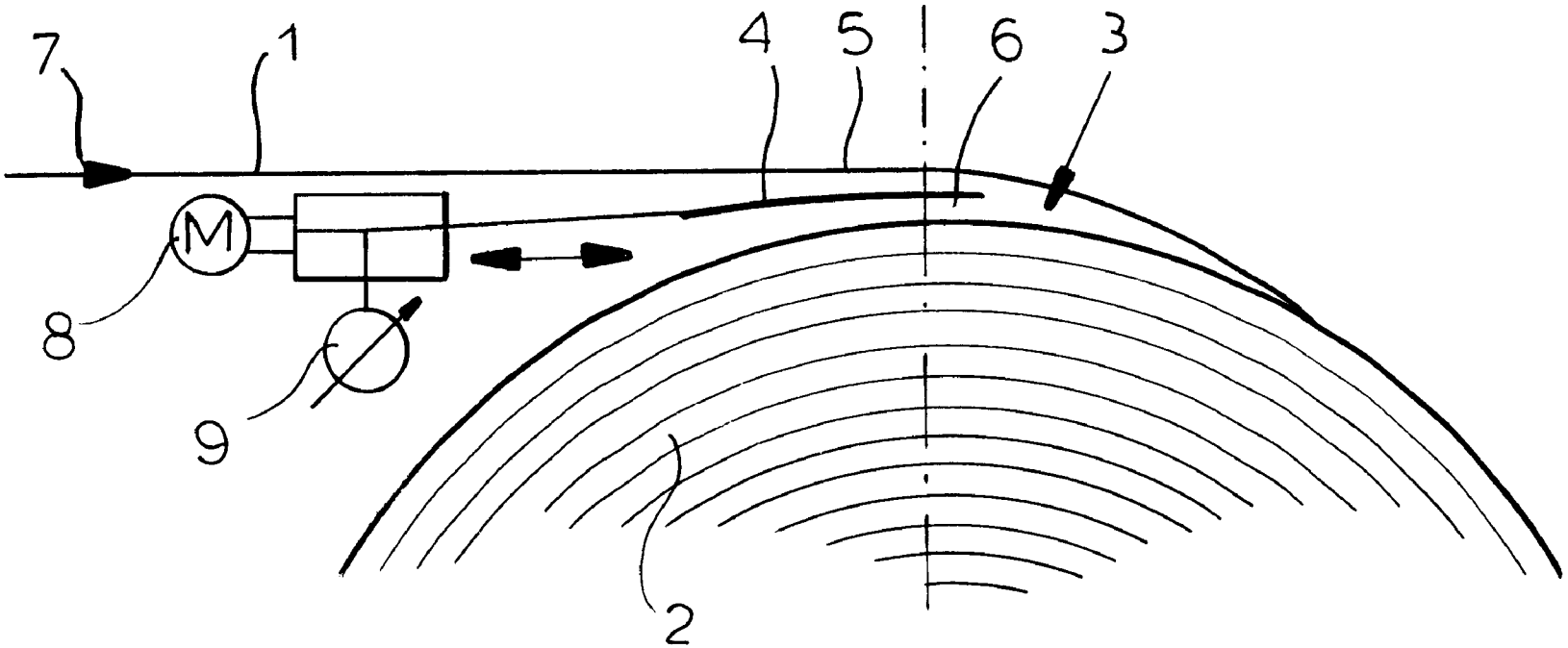
FIG. 1 shows the use of a foil as separating element in the winding of the web to a wound roll.

In FIG. 1 the arrangement and form of a separating and partition element according to the invention has been illustrated by way of example in the winding up of a web 1, preferably a paper, cardboard or synthetic resin web, to a wound roll 2. In the production of wound rolls 2, the air boundary layers adhering to the web 1 and to the outer most layer of the wound roll cause problems. It is necessary to avoid the incorporation of large amounts of air into the wound roll since this gives rise to an undesired effect on the winding hardness and to winding defects, especially folds, in the wound roll. The web 1 running toward the wound roll 2 forms with the outermost layer thereof a converging inlet gap 3 in which the entrained air builds up to an overpressure. The overpressure, especially in the case of very large web widths of several meters and by impermeable materials, is brought down slowly since the air can escape only with difficulty.

In the inlet gap 3, a bendable separating element [partition] 4 is so arranged so as to extend somewhat parallel to the plane of the web such that the inlet gap 3 from the inlet side inwardly is subdivided into two flow passages 5, 6. The separating element 4 is mounted at its rear end, relative to the direction of the movable surfaces—here the web 1. Its front, free end is of flat configuration and extends into the gap 3 without contacting the web 1 or the other element defining the gap 3 (the wound roll 2). The bendable separating element 4 is comprised of a flexible material, especially a synthetic resin foil so that it can orient itself automatically in the middle of the inlet gap 3. A suitable separating element 4 is a plastic foil of about 50 $\mu$m to 100 $\mu$m in thickness.

The separating element 4 extends into the gap 3 sufficiently that the flow passages 5 and 6 at the narrowest location at the front end of the separating element have a maximum height of 1 mm. Thereafter the feed gap 3 widens suddenly. As a result at this location there is a reduction of the volume flow rate of entrained air and a pressure drop which improves the contact between the oncoming web 1 and the winding roll 2. So that the pressure drop in the feed gap will extend over the entire width of the web and, preferably, the separating element extends over the entire width of the web 1.

Since the magnitude of the pressure drop depends, inter alia, upon the position of the separating element 4, it can be influenced by the penetration depth of the separating element 4 in the gap 3. Preferably the separating element 4 is so fastened at the inlet side that the penetration depth in the gap 3 can be varied. As has been shown in FIG. 1, the mounting of the separating element at the inlet side is adjustable by a positioning motor 8 in a direction counter to the web travel direction (arrow 7). Because of the frictional engagement with the entrained air, the separating element 4 is pulled with a certain force into the gap 3. This affords the possibility to control the pressure condition at the end of the gap by this tension force. The tension force can serve, via a force measuring device 9 as a control parameter by means of which the position of the separating element 4 is adjusted by the motor 8 as a function of the measured force. During the winding up of the web, the penetration depth of the separating element 4 is controlled as a function of the diameter of the winding roll 2 and the speed of the web 1. Preferably this is effected automatically by a control device which so controls the positioning motor that predetermined values of the tension force are maintained.

Figure 2:
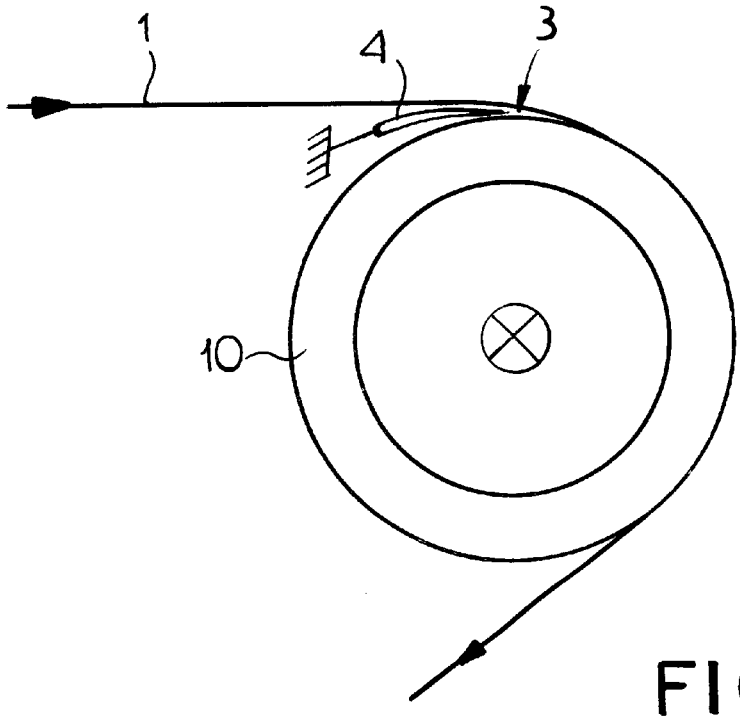
FIG. 2 shows the use of a separating element on a web tension roller.

FIG. 2 shows the arrangement of a separating element 4 in the inlet gap 3 between a web 1 of the paper, cardboard or synthetic resin and a driven web tensioning roller 8. Also in this embodiment, the separating element 4 orients itself automatically in the inlet gap 3 without contact with the web 1 or the roller 10. The pressure drop downstream of the separating element 4 ensures that the web 1 will adhere without slip to the driven roller 9. The floating of the web 1 on an air cushion formed by entrained air is avoided. In this manner, with rollers 10 with smooth metallic surfaces exceptionally height tractive tensions can be transmitted to the web 1. Marking as can occur with for example rollers with grooves on sensitive synthetic resin foils, is avoided.

The arrangement of a separating element according to the invention is also advantageous for freely rotatable guide rollers for webs of material. A slip free contact between the web and the roller must be ensured even for nondriven guide rollers to avoid a lateral travel of the web or marking of sensitive webs. Thus the separating elements according to the invention can be advantageously arranged in the gap formed as webs pass onto rolls or rollers of so-called edge control units. Such edge control units serve to guide the longitudinal edges of webs with precision.

Figure 3:
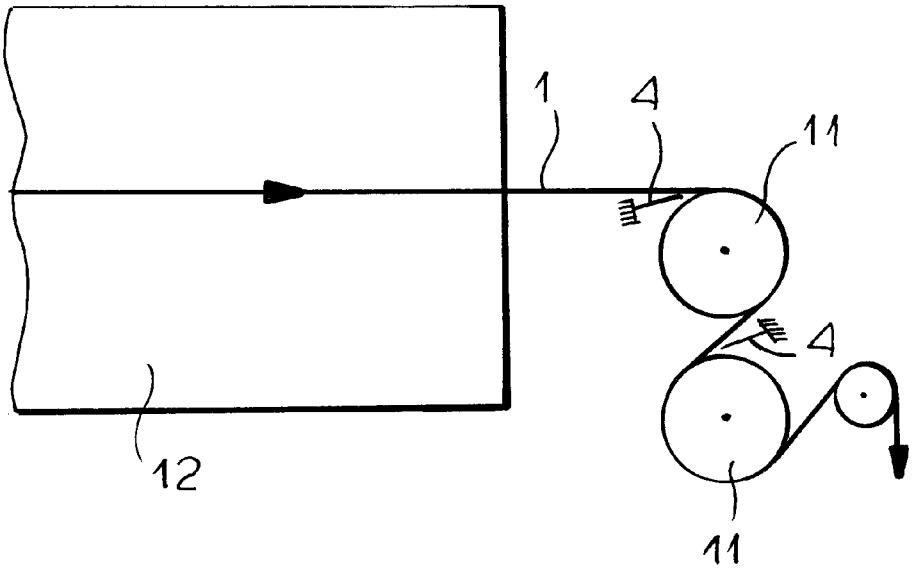
FIG. 3 shows the use of separating elements in a cooling roller group downstream of a dryer of a coating apparatus for web shaped material.

Furthermore, the separating elements can be used advantageously with cooling or heating rollers for webs so as to improve the heat transmission between the roller surface and the web. The air volume which is entrained into the inlet gap as the web runs into engagement with the cooling or heating roller reduces the heat transfer and thus the cooling or heating efficiency. In FIG. 3 the arrangement of separating elements 4 in a cooling roller group 11 in conjunction with a dryer 12 of a coating device has been shown. The separating elements 4 arranged in the inlet gap 3 between a cooling roller 11 and the web 1 in the aforedescribed manner reduces the volume of entrained air.

Figure 4:
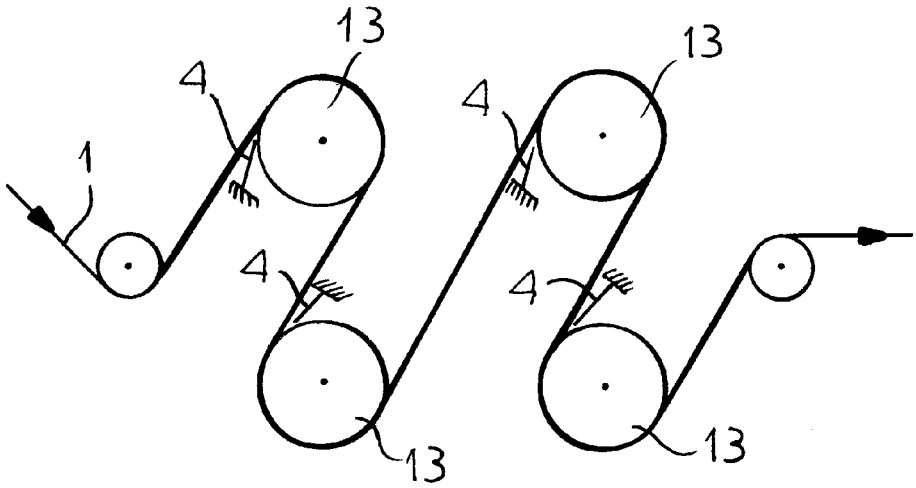
FIG. 4 shows a heating roller group for heating and controlling the tension of synthetic resin foils.

FIG. 4 shows a group of heating rollers 13 for heating and controlling the tension of synthetic resin foils. A feed gap for the web 1 leading to each heating roller 13 also has a separating element 4 arranged therein in order to improve the heat transfer with this heating roller group. Since the cooling rollers 11 and the heating rollers 13 axially also serve as tension rollers, the separating elements 4 improve the adhesion to the respective rollers 11, 13 at the same time. This permits an increased tensile force to be applied to the web 1.

Figure 5:
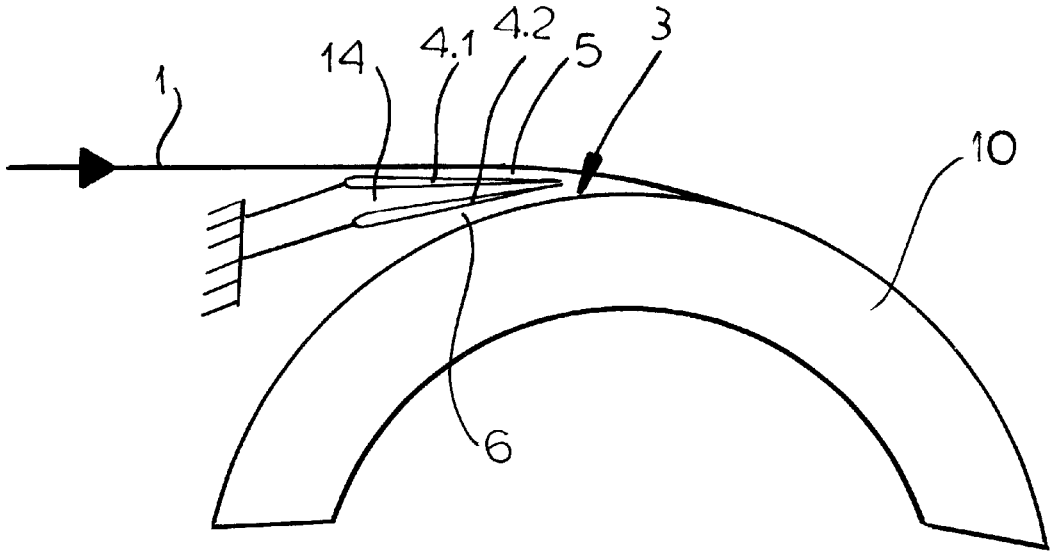
FIG. 5 shows the use of two separating elements in the inlet gap of a web to a roller.

Instead of only one separating element 4, two or more separating elements 4.1 and 4.2 can be arranged in the gap 3 as has been illustrated in FIG. 5. Each of the separating elements 4.1 and 4.2 is then configured and mounted as has been described previously in the manner described in the description to FIG. 1. The arrangement of the two separating elements 4.1, 4.2 subdivides the gap into three flow passages 5, 6, 14 which at the ends of the separating elements 4.1, 4.2 make a transition to a flow passage of greater height. The arrangement of two or more separating elements 4.1, 4.2 has the advantage that the height difference of the passages ahead of and behind the separating elements can be greater to increase the effect and also permits the possibility of adjusting the pressure between the two separating elements 4.1, 4.2 so as to influence the geometry of the outer flow passage 5, 6. It is thus possible to connect the two separating elements 4.1, 4.2 at their leading ends together in the gap 3, for example, by welding or adhesive bonding to build up a pressure between the separating elements by blowing air in from the inlet side so as to press the separating elements into the desired position. The separating element in this embodiment has the configuration of a flat tube with a wedge shaped cross section extending into the gap 3.

Figure 6:
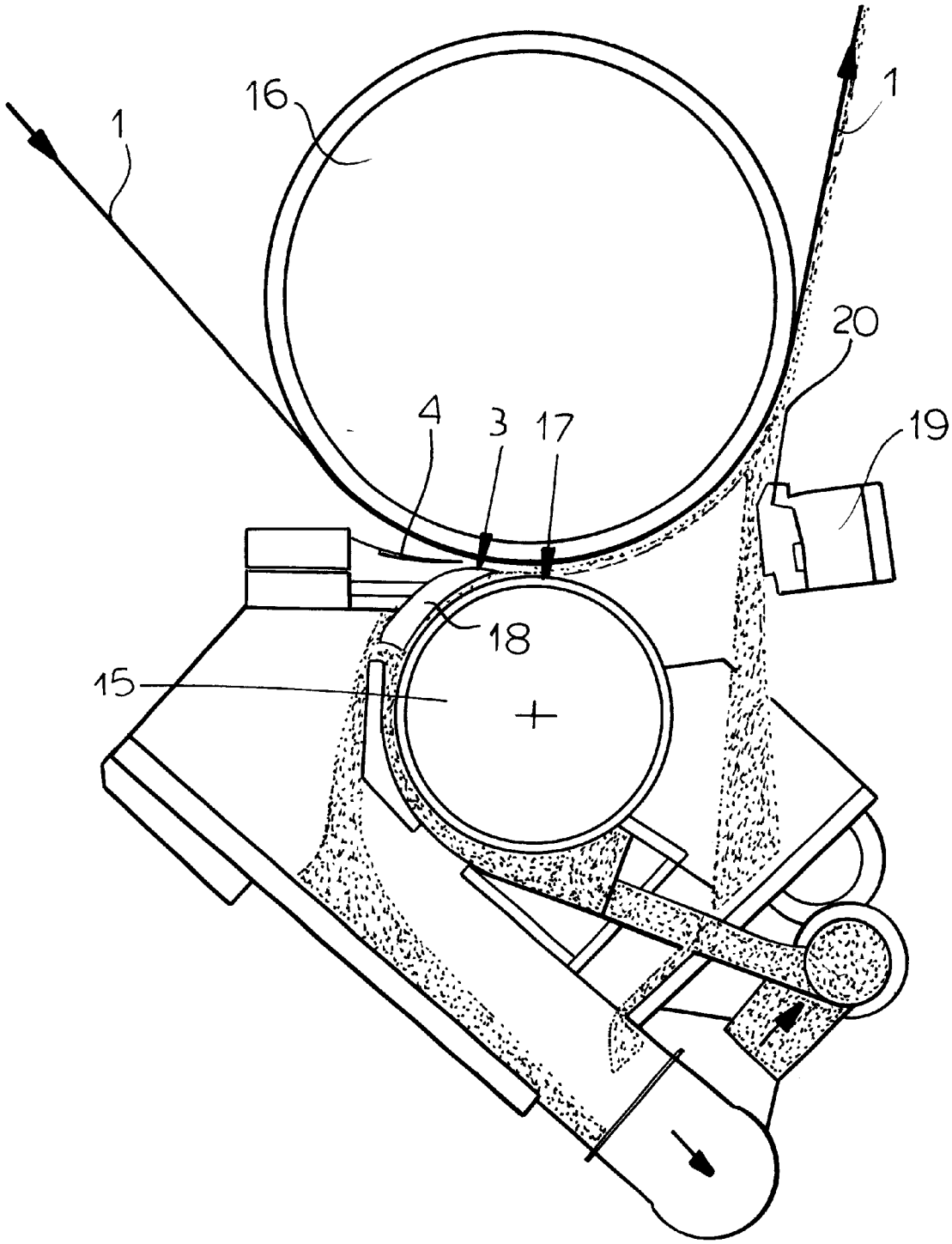
FIG. 6 shows a side view of a coating device in which a separating element is used to break down the air boundary layer ahead of the cooling gap.
Figure 7:
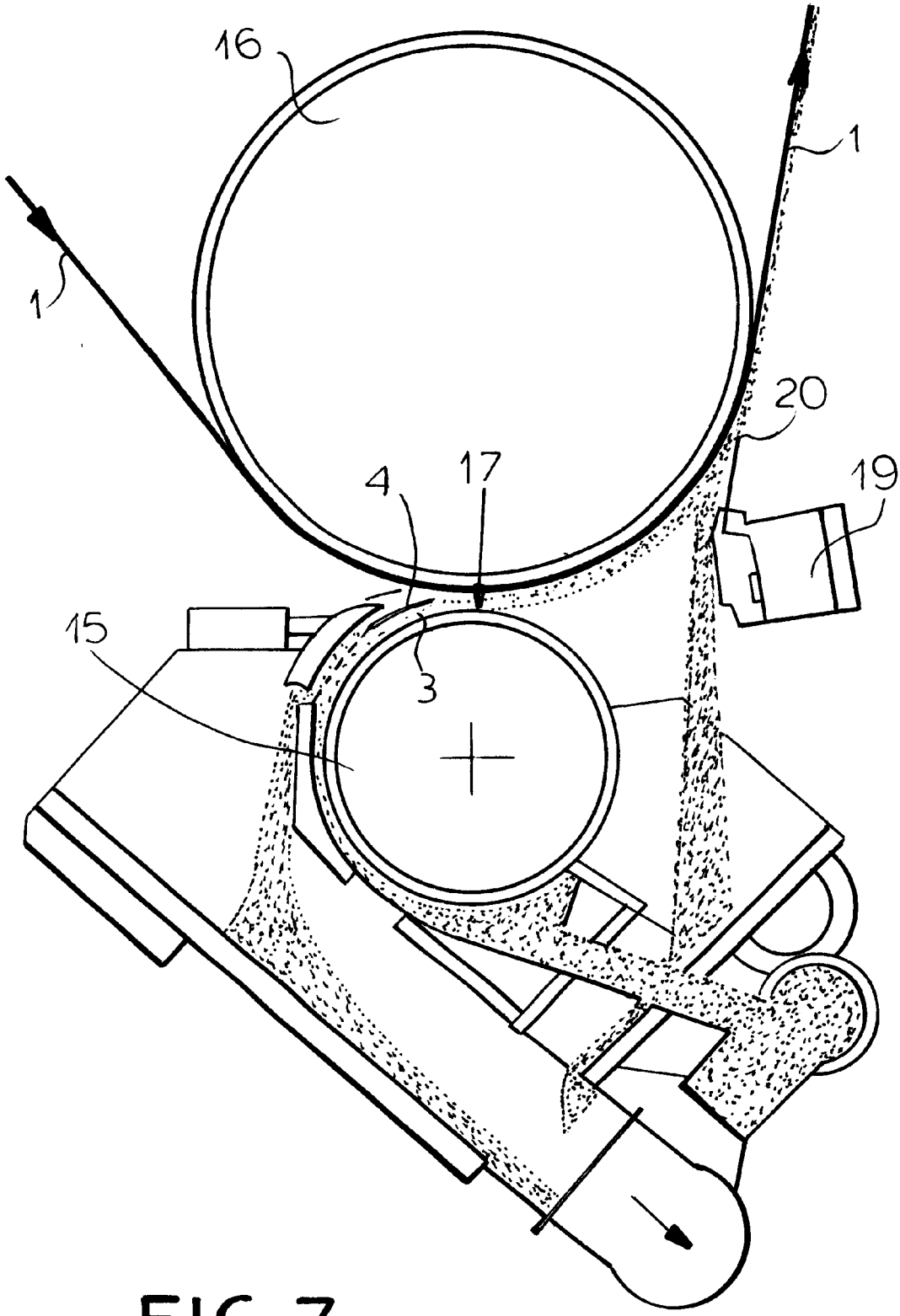
FIG. 7 shows a side view of a coating device in which the separating element serves to reduce the liquid pressure in the application gap.

In FIGS. 6 and 7, the use of a separating element 4 in a coating device has been shown. The coating material is applied to the web 1 by an applicator—here an applicator roller 15—the web 1 being supported during the application by a counter-roller 16. The applicator roller 10 forms with the web 1 an applicator gap 3 in which the coating material supplied by the applicator roller 15 is transferred onto the web 1. Such coating devices are used to coat paper or cardboard web with pigment coatings.

At especially high web speeds in excess of 1500 m/min the air boundary layer adhering to the web 1 interferes with the transfer of the coating material from the applicator to the web 1 with the consequence that uncoated regions arise or nonuniform coat result. In the coating device shown in FIG. 1, a separating element 4 shows to reduce the air boundary layer before the application. Thus at a small distance upstream of the applicator gap 17 a guide level 18 is disposed which forms with the web 1 a converging gap 3. The gap 3 is subdivided into two flow passages by the separating element which is constructed and arranged as has been described in the embodiment of FIGS. 1 and 2. Directly downstream of the separating element 4, at the position at which the coating material comes in contact with the web 1 there is a reduction in the volume of the air boundary layer. This improves the transfer of the coating material from the applicator roller 15 to the web 1 with the positive effect that either the excess of coating material is reduced and/or the web speed can be increased without uncoated regions of the web 1 arising. The use of a separating element 4 according to the invention in cooling units is not limited to the type of machine shown in FIG. 6 with a roller applicator. It can be used with all coating devices to reduce the negative effects of the air boundary layer.

In FIG. 7 a coating device has been shown in which the separating element 4 serves to reduce the liquid pressure in the applicator gap 17. An excessive pressure in applicator gap 17 results especially with bibulous paper or cardboard webs in excessive penetration of the coating material undesirably into the web 1. The separating element 4 is so arranged that its front free end extends into the liquid coating material filled applicator gap 17. It subdivides the applicator gap 17 into two flow passages and effects a drop in the liquid pressure.

Usually an excess of coating material is applied to the web by the applicator roller 15 of the coating device of FIGS. 6 and 7. The excess is stripped off in a known manner by a metering system 19 which is downstream of the applicator roller 15 in the web travel direction, to a desired coating web. The metering system 19 contains a known metering element, for example, a shaving blade 20 which doctors off the excess and smooths the applied layer.

The use of a separating element according to the invention is not limited to the aforedescribed examples. It can be used generally where a movable surface entrains a fluid, i.e. a liquid or a gas, into a gap and whose pressure on volume gives rise to undesired effects. The invention enables the volume or pressure of the entrained fluid to be reduced without requiring the movable surface or a further ailment to be contacted or units to be employed which require energy, for example, suction devices.

What is claimed is:

1. A method of reducing a volume or pressure of a fluid entrained by a moving surface into an inlet gap comprising the steps of:

(a) displacing at least one moving surface convergingly toward another surface so as to define between said surfaces an inlet gap into which a fluid is entrained and converging in a direction of displacement of said moving surface; and (b) subdividing said gap into at least two flow passages by inserting into said gap at least one bendable separating element supported at a rear end thereof at a location spaced from a narrowest portion of said gap and having a flatly configured front end extending into said gap, each said separating element being sufficiently flexible to orient itself with its front end between respective said flow passages on opposite sides thereof.

2. The method defined in claim 1 wherein said separating element is so positioned in said gap that the flow passages on opposite sides thereof at respective narrowest locations have heights of a maximum of 1 mm.

3. The method defined in claim 1, further comprising the step of regulating a depth of penetration of said separating element into said gap.

4. The method defined in claim 3 wherein the depth of penetration of said separating element into said gap is regulated by:

detecting a force on said separating element tending to draw said separating element into said gap; and controlling a position of said separating element in said gap based upon the detected force.

5. The method defined in claim 1 wherein said moving surface is a surface of a web displaced toward a surface of a roller forming the other of said surfaces.

6. A device for reducing a volume or pressure of a fluid entrained by a moving surface into an inlet gap in combination with:

at least one moving surface convergingly toward another surface so as to define between said surfaces an inlet gap into which a fluid is entrained and converging in a direction of displacement of said moving surface, said device comprising:

at least one bendable separating element extending into said gap and subdividing said gap into at least two flow passages; and a support for each said separating element and engaging said separating element at a rear end thereof at a location spaced from a narrowest portion of said gap, said separating element having a flatly configured front end extending into said gap, each said separating element being sufficiently flexible to orient itself with its front end between respective said flow passages on opposite sides thereof.

7. The device defined in claim 6 wherein said separating element is a foil having a thickness between 50 $\mu$m and 100 $\mu$m.

8. The device defined in claim 7, further comprising an adjusting element connected to said separating element and varying a depth of penetration of said separating element into said gap.

9. The device defined in claim 8 wherein said adjusting element includes a force-measuring sensor detecting a force with which said separating force is drawn into said gap for controlling the depth of penetration.

10. The device defined in claim 9 wherein said adjusting element is a motor-driven setting drive.

11. The device defined in claim 6 wherein said at least one moving surface is a paper, cardboard or synthetic resin web and said other surface is a winding roll for said web, said gap being formed between said web and said winding roll.

12. The device defined in claim 11, further comprising a controller for positioning said separating element as a function of a diameter of said wound roll.

13. The device defined in claim 6 wherein said at least one moving surface is a web and said other surface is a surface of a web tension roller engaged by the web, further comprising a drive for said web tension roller.

14. The device defined in claim 6 wherein said at least one moving surface is a surface of a web and said other surface is a surface of a guide roll around which said roll is guided.

15. The device defined in claim 6 wherein said at least one moving surface is a surface of a web and said other surface is a surface of a cooling roller around which said web is looped.

16. The device defined in claim 6 wherein said at least one moving surface is a surface of a web and said other surface is a surface of a heating roller around which said web is looped.

17. The device defined in claim 6 wherein said at least one moving surface is a surface of a web and said other surface is a surface of an applicator roller applying a coating material to said web.

* * * * *